United States Patent [19]

Kinoshita et al.

[11] Patent Number: 4,955,317

[45] Date of Patent: Sep. 11, 1990

[54] IMAGE FORMING APPARATUS HAVING A PLURALITY OF DEVELOPING UNITS EACH CONTAINING TWO-COMPONENT DEVELOPER

[75] Inventors: Naoyoshi Kinoshita; Yoshihiko Hatta, both of Osaka, Japan

[73] Assignee: Minolta Camera Kabushiki Kaisha, Osaka, Japan

[21] Appl. No.: 357,894

[22] Filed: May 25, 1989

[51] Int. Cl.[5] ..... G03G 15/08

[52] U.S. Cl. ..... 118/689; 355/246; 355/326

[58] Field of Search ..... 118/689, 691; 355/246, 355/251, 253, 326, 327

[56] References Cited

U.S. PATENT DOCUMENTS

| | | | |
|---|---|---|---|
| 4,342,283 | 8/1982 | Terashima | 118/689 |
| 4,592,645 | 6/1986 | Kanai et al. . | |
| 4,734,737 | 3/1988 | Koichi | 118/689 X |
| 4,875,079 | 10/1989 | Bisaiji et al. | 355/246 |

*Primary Examiner*—R. L. Moses

*Attorney, Agent, or Firm*—Burns, Doane, Swecker & Mathis

[57] ABSTRACT

An electrophotographic image forming apparatus employing a two-component developer including toner and carrier comprises: a developing unit containing the developer; a toner concentration sensor provided on the developing unit for detecting the concentration of the toner included in the developing unit; a comparing apparatus for comparing a value detected by the toner concentration sensor with a prescribed concentration reference value; a supplying apparatus for supplying toner to the developing unit; a controlling apparatus for controlling toner supply by the supplying apparatus based on the result of comparison by the comparing apparatus; and a detecting apparatus for detecting whether or not a detachable member whose attachment influences the detection of the toner concentration sensor is attached near the developing unit. The controlling apparatus changes the amount of toner supply by the supplying apparatus based on detected value from the toner concentration sensor in response to the detection output from the detecting apparatus.

22 Claims, 14 Drawing Sheets

IMAGE FORMING APPARATUS HAVING A PLURALITY OF DEVELOPING UNITS EACH CONTAINING TWO-COMPONENT DEVELOPER

BACKGROUND OF THE INVENTION

1. Field of the Invention

The present invention relates to an image forming apparatus and, more specifically, to improvements in controlling toner concentration in an image forming apparatus having a plurality of developing units according to two-component developing system.

2. Description of the Related Art

In image forming apparatuses such as printers and electrophotographic copying machines, developing units of the two-component developing system using toner and carriers are generally employed. When such a developing unit is employed, the proportion of the toner to the carrier must be maintained at a constant value in order to provide uniform image density. The proportion of the toner and the carrier (the weight proportion of the toner to the total weight of the toner and the carrier) is called T/C ratio. In order to maintain the T/C ratio at a constant value, typically a toner concentration sensor is used, which converts permeability of the developer into voltage and detects the voltage as the T/C ratio.

The sensor comprises a concentration detecting coil L2, an oscillating coil L1 and a comparing coil L3 wound around the same bobbin 33 having a ferrite core 31 as shown in FIGS. 15 and 16, which is contained in a case 30 to be attached to a bottom of a developer tank 80 of the developing unit. In the example shown in the figure, it is fitted in a hole 801 provided on the bottom of the developer tank 80.

An oscillating circuit C1 is connected to the oscillating coil L1. The concentration detecting coil L2 and the comparing coil L3 are connected in series to have the opposite phases, the output voltage therefrom is transmitted to a phase detecting circuit C2 in which a voltage based on the phase difference between the output voltage from the coils L2 and L3 and a reference voltage of the coil L1 is generated to be outputted therefrom.

More specifically, if the concentration of the developer in the developer tank 80 becomes higher, in other words, if the ratio of the toner in the developer tank increases and the ratio of the carrier decreases, the inductance of the coil L2 becomes smaller. Otherwise, the inductance of the coil L2 becomes larger.

The sensor detects the change in the concentration of the developer as the change of the inductance of the concentration detecting coil L2, whereby the phase difference between the output voltage from the coils L2 and L3 and the reference voltage of the coil L1 is taken out as the change of voltage by means of the phase detecting circuit C2. The output value therefrom is as shown in FIG. 17, for example.

The sensor output value or the detected value provided in this manner is compared with a predetermined reference level value. The amount of toner supply in the developing unit is controlled based on the result of comparison to maintain the T/C ratio at a constant value.

Assuming that the output of the toner concentration sensor changes as represented by the curve A in FIG. 19, the actual output of the sensor concentration deflects from the aimed curve A as shown by a or a' in FIG. 19 because of the variation of the developing units, difference of the developer corresponding to different manufacturing lots (mainly caused by the difference of the particle size of the carriers) and of differences in output adjustment performed in manufacturing the sensors.

Therefore, when a new image forming apparatus is operated for the first time, or when a new developer is used, the sensor output for each of the developing units must be adjusted to provide the characteristic of the aimed curve A shown in FIG. 19.

Such adjustment is carried out in the following manner. Namely, a new developer whose T/C ratio is stable and is known in advance is introduced into the developing unit and a core 31 in the sensor is moved by rotating the same by a driver DR inserted through a hole 32 provided on the sensor case 30 as shown in FIG. 15, so as realize the prescribed value of the curve. In the sensor shown in FIG. 15, the core 31 can be up and down, screwed around a female screw hole 34 in a bobbin 33.

Recently, image forming apparatuses such as copying machines and printers which are compact and having or capable of accommodating a plurality of developing units have to come to be widely used, as compact apparatuses and image forming apparatuses capable of color printing have been strongly desired. In such an image forming apparatus, only a small space is available for one developing unit. Accordingly, the space between developing units becomes smaller, and sometimes a developing unit is arranged very close to the toner concentration sensor of the said type provided on another developing unit. Such an apparatus may be used with some of the developing units unattached thereto. Therefore, if the sensor as described above is provided on the bottom of the developing unit, the inductance of the comparing coil L3 of the sensor may be changed dependent on whether or not a developing unit is provided below and near to the sensor, causing changes in the sensor output (see FIG. 18). In FIG. 18, the reference character d represents a distance between the sensor and an upper aluminum lid of another developing unit provided below the sensor. The comparing coil L3 is much influenced especially when the portion (for example, lid) of the developing unit provided in the proximity below the sensor is formed of a ferromagnetic body such as iron. Consequently, the value detected by the toner concentration sensor fluctuates widely dependent on the presence/absence of the developing unit therebelow. Even if the material of the upper portion of the developing unit provided below the sensor is not a ferromagnetic body, the same problem occurs if there is little space in the developing unit and much developer is contained in the developing unit (especially when the developing unit is compact).

When such a toner concentration sensor measuring permeability is used, the output value or the detected value of the toner concentration sensor fluctuates dependent on whether or not another developing unit is provided in a range in which the said another developing unit influences the output value or the detected value of the sensor, disabling accurate control of the toner concentration.

There is also a problem in adjusting the output of the toner concentration sensor for each of the developing units when a new developer is used or when a new image forming apparatus is operated for the first time, as described above. Namely, if the adjustment is carried out such that a constant level value is provided regardless of the presence/absence of another developing units arranged close to the sensor, then the actual concentration of the developer is changed dependent on the presence/absence of another developing unit in the range in which the said another developing unit influences the sensor output value from adjusting sensor.

SUMMARY OF THE INVENTION

An object of the present invention is to properly control toner concentration in a developing unit in an electrophotographic image forming apparatus.

Another object of the present invention is to properly control toner concentration of a developing unit regardless of presence/absence of another developing unit at arranged close to the objective developing unit in an electrophotographic image forming apparatus.

A further object of the present invention is to improve precision in detecting by a sensor detecting toner concentration of a developing unit in an electrophotographic image forming apparatus.

A still further object of the present invention is to improve precision in detection of a sensor detecting toner concentration of a developing unit, regardless of presence/absence of a developing unit arranged closed to the objective developing unit in an electrophotographic image forming apparatus.

A still further object of the present invention is to properly control toner concentration of a developing unit regardless of another developing unit arranged closed to the objective developing unit, in a method of adjusting toner concentration in an electrophotographic image forming apparatus.

The above described objects of the present invention can be attained by an electrophotographic image forming apparatus of the present invention, which is an electrophotographic image forming apparatus having a two-component developer including toner and carrier, comprising: a developing unit; a toner concentration sensor; comparing means; supplying means; controlling means and detecting means. The developing unit contains a developer. The toner concentration sensor is provided on the developing unit to detect the concentration of the toner contained in the developer. The comparing means compare the value detected by the toner concentration sensor with a prescribed concentration reference value. The supplying means supplies toner to the developing unit. The controlling means controls the supply of the toner by the supplying means based on the result of comparison carried out by the comparing means. The detecting means detects whether or not a member which is detachably provided in the proximity of the developing unit, the attachment of the member influencing the detection of the toner concentration sensor, is attached. The control means changes the amount of toner supplied by the supplying means based on the value detected by the toner concentration sensor, in response to the detected output of the detection means.

In the electrophotographic image forming apparatus structured as described above, the amount of toner supply is changed dependent on the presence/absence of a member provided near the developing unit. Therefore, the toner concentration in the developing unit can be properly controlled.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

One embodiment of the present invention will be described in the following with reference to the figures.

Figure 1:
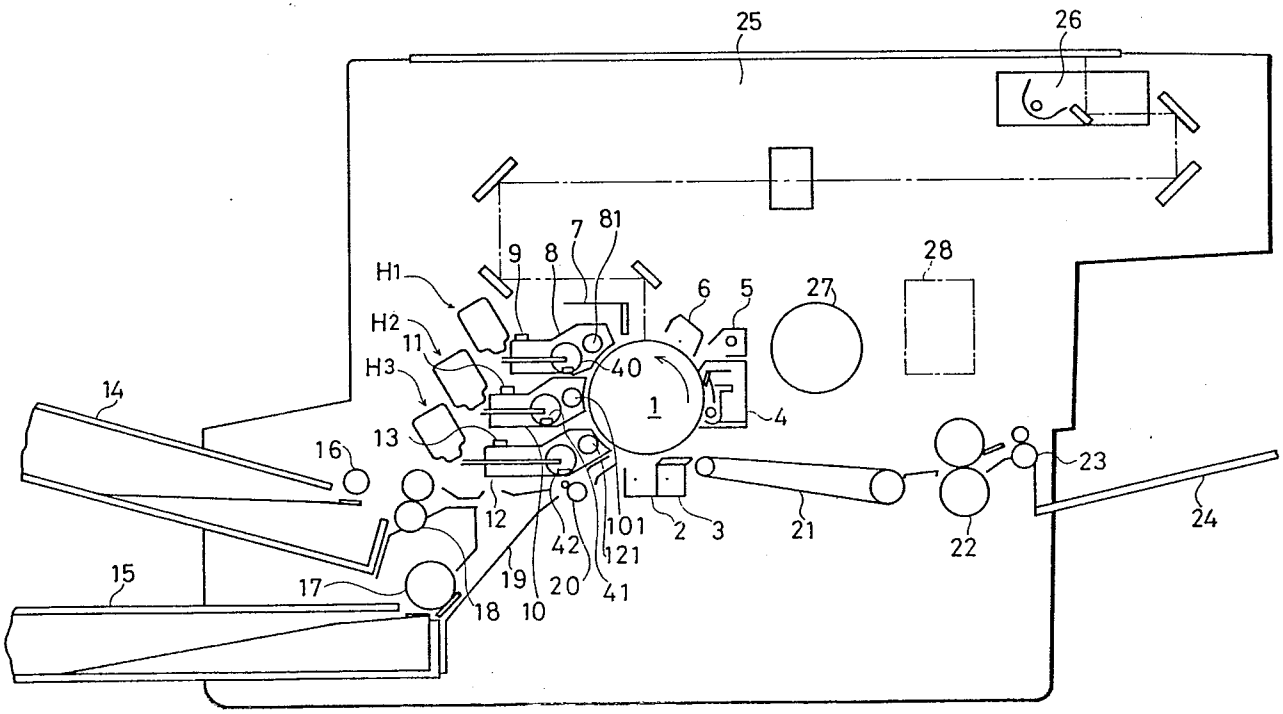
FIG. 1 is a schematic cross sectional view of a copying machine in accordance with one embodiment of the present invention.

FIG. 1 show a schematic cross section of a copying machine to which the present invention is applied. Referring to the figure, a photoreceptor 1 is provided approximately at the center of the copying machine, and a corona charger 6, an LED array 7, an upper developing unit 8, an intermediate developing unit 10, a lower developing unit 12, a transfer charger 2, a separation charger 3, a cleaning apparatus 4 and a main eraser lamp 5 are successively arranged therearound.

An original placed on a platen glass is scanned by a scanner 26 of an optical system 25 while being irradiated, and the photoreceptor 1 is exposed corresponding to the images on the original in the downstream side of the corona charger 6. A sheet of paper is supplied from an upper paper feeding cassette 14 through a paper feeding roller 16 and an intermediate roller 18 or from a lower paper feeding cassette 15 through a paper feeding roller 17.

The fed sheet of paper is transported along a guide 19 to the transfer charger 2 through a timing roller 20. A conveying portion 21, a fixing roller 22, a paper discharging roller 23 and a paper discharging tray 24 are provided downstream of the chargers 2 and 3.

A main motor 27 is provided in the copying machine, which motor rotates and drives the photoreceptor 1, the paper feeding rollers 16, 17, an intermediate roller 18, the timing roller 20, the conveying portion 21, the fixing roller 22, the discharging roller 23, developing sleeve rollers 81, 101, 121 in the developing units and developer mixing/carrying bodies such as bucket roller.

The paper feeding roller, the intermediate roller, the timing roller, the sleeve roller and so on are adapted to be driven through electromagnetic clutches so as to be rotated as needed.

Each of the developing unit 8, 10 and 12 is detachable from the copying machine and contains two-component developer, and the toners comprised in each of the developers are different from each other in color. Further, each of the developing units 8, 10 and 12 has an index (not shown in the drawings), representing the presence of the unit as well as the color of the internal toner, on the upper surface of the unit.

Detecting devices 9, 11 and 13 are provided in the copying machine to detect the indexes attached to the respective developing units.

Each of the detecting devices outputs 3 bits-signal to a microcomputer 51, which will be described later, and the color of the toner and the presence/absence of the developing unit can be detected dependent on the combination of "high" and "low" of bits of the signal.

The developing units 8, 10 and 12 comprises toner concentration sensors (ATDC sensors) 40, 41 and 42, respectively. Each of the ATDC sensor is of the type shown in FIGS. 15 and 16 for measuring permeability, and is fitted in an opening provided on the bottom of the developing tank case.

Figure 2:
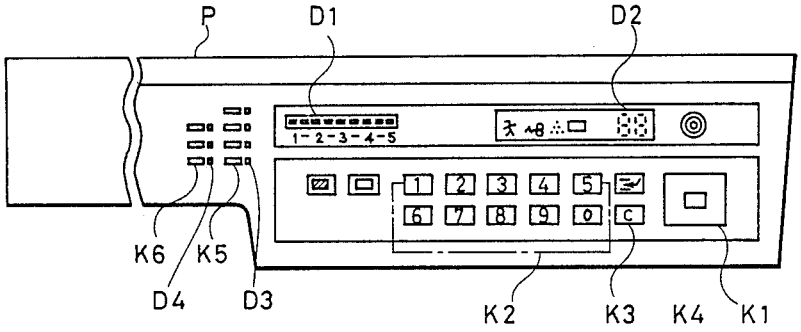
FIG. 2 is a partial plan view of an operation panel provided on a surface of the copying machine shown in FIG. 1.
Figure 3A:
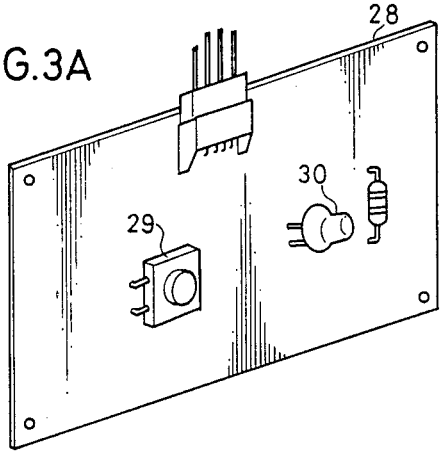
FIG. 3A is a perspective view of an operation panel in the copying machine of FIG. 1.

The copying machine has an operation panel P such as shown in FIG. 2 on the surface thereof, and an operation panel 28 such as shown in FIG. 3A at a position easily accessible in the copying machine. The operation panel P comprises a print switch K1 for starting the copying operation; a group of keys K2 for setting numbers; a clear key K3; an interruption key K4; a group of keys K5 for selecting paper size and a group LEDs D3 for indicating the size of the selected paper; a group of keys K6 for selecting developing units and a group LEDs D4 for indicating the selected developing units; an exposure amount displaying portion D1; a copy number displaying portion D2; and so on.

On the operation panel 28 as shown in FIG. 3A in the copying machine provided are a key 28 for starting an adjustment mode for adjusting output of the ATD sensors in the developing units and a light emitting diode (LED) 30 for monitoring the adjustment of the output.

Figure 4:
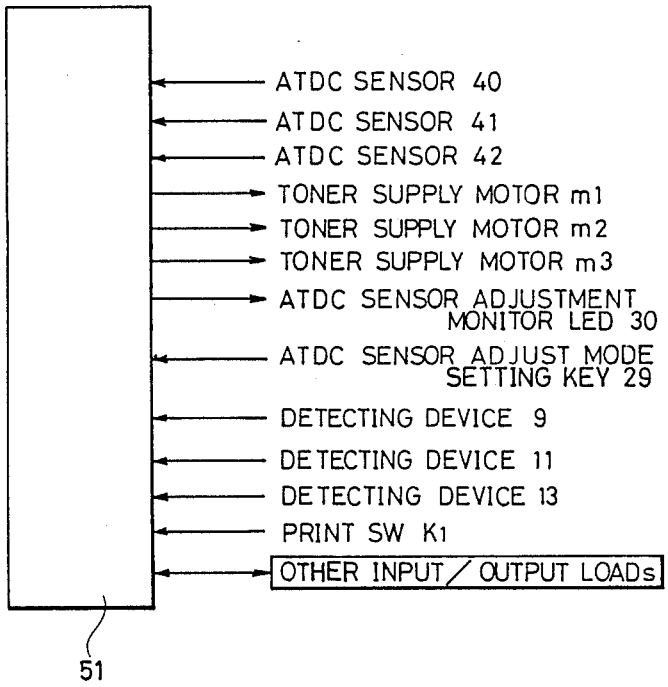
FIG. 4 is a schematic block diagram of a controlling circuit of a copying machine in accordance with one embodiment of the invention.

The copying machine is controlled by a controlling circuit schematically shown in FIG. 4.

Referring to the block diagram of the controlling circuit shown in FIG. 4, the detecting devices 9, 11 and 13, the ATDC sensors 40, 41 and 42 of the developing units, the print switch K1 on the operation panel P and the key 29 for setting the ATDC sensor adjustment mode on the operation panel 28 are connected to input ports of the microcomputer 51. Driving circuits of motors m1, m2 and m3 (not shown) for toner supply provided in the developing units 8, 10, 12, respectively and the LED 30 for monitoring the adjustment ATDC sensor on the operation panel 28 are connected to output ports of the microcomputer 51. Other input/output loads including input means on the operation panel P are also connected to the microcomputer 51.

The motors m1, m2 and m3 for toner supply in the developing units are motors for supplying toner to the developing tanks from toner hoppers H1, H2 and H3 by driving toner supplying mechanism in the developing units. A mechanism such as shown in the U.S. Pat. No. 4,423,948 may be used as the toner supplying mechanism, for example.

The operation of the copying machine will be briefly described. The photoreceptor 1 is rotated in the counterclockwise direction as viewed in the figure, it is uniformly charged by the corona charger 6 and is exposed corresponding to the images on the original by the optical system 25. Latent electrostatic images formed by the exposure are developed by the developing units 8, 10 and 12 applying toner thereto. The toner images are transferred by the transfer charger 2 to a sheet of paper which is fed by the timing roller 20 with the end thereof aligned with the images. The sheet of paper is separated from the photoreceptor 1 by the separating charger 3, transferred to the fixing roller 22 through the conveying portion 21, the toners are fixed on the paper, and the sheet is discharged to the discharging tray 24 by the paper discharging roller 23.

Figure 20:
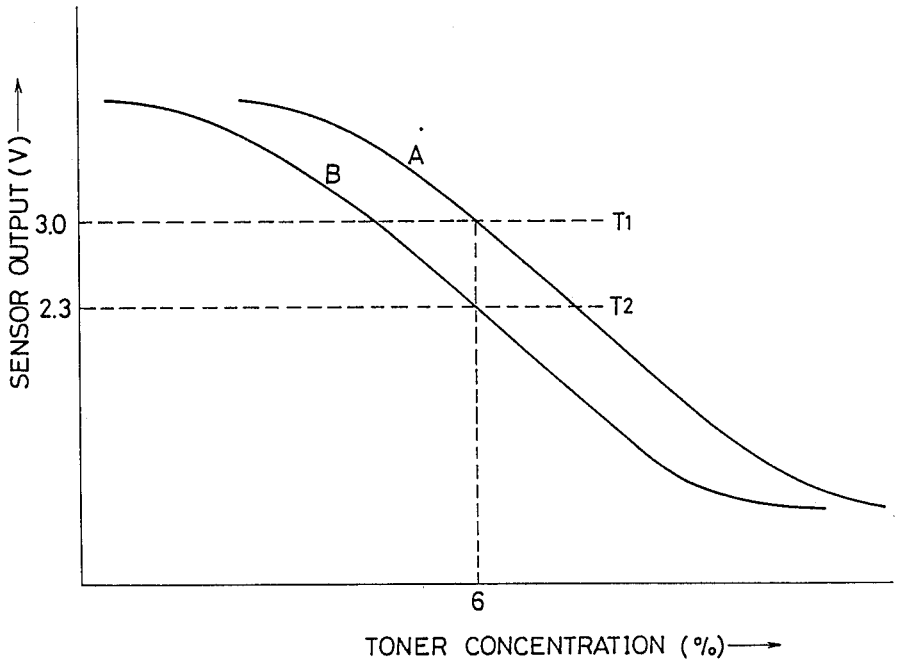
FIG. 20 is a graph showing the relations between the toner concentration in a developer and the sensor output when another developing unit influencing the output of a common toner concentration sensor is provided near the sensor and when not.

A developer having the T/C concentration of 8% is initially contained in the developing units of the copying machine of the present embodiment, and the toner concentration gradually decreases as the developing units are used. The toner concentration is detected as a voltage value by the ATDC sensor provided in each of the developing units, which value is inputted to the microcomputer 51. A reference level value for comparison is stored in advance in the microcomputer 51 for determining whether or not toner is to be supplied from the toner hopper. The reference level value for comparison comprises level values T1 and T2, namely, the level value T1 which is used when a developing unit is provided below and close to each of the sensors 40 and 41, that is, when the developing unit directly below the sensor is attached, and the level value T2 which is used when there is no developing unit provided below the sensor. Either the value T1 or T2 is employed dependent on the presence/absence of the developing unit below the sensor. The level value T2 is set for the sensor 42 of the lower most developing unit 12, since there is no developing unit which can be attached therebelow. The level value T1 is selected to be a little higher than the level value T2. FIG. 20 shows a relation between the toner concentration in the developer and the sensor output. The curve A is the sensor output when a developing unit is attached directly below the sensor, while the curve B represents the sensor output when there is no developing unit below the sensor. The present embodiment is adapted to supply toner when the toner concentration is lowered to 6%. Therefore, the level values T1 and T2 are respectively set at 3.0 V and 2.3 V. For example, when the developing unit 8 is used and the developing unit 10 is also attached, the toner is supplied by the toner supply motor m1 so that the specified concentration of the toner is regained, when the value of the toner concentration detected by the sensor 40 becomes higher than T1. When the developing unit 10 is not attached, the detected value from the sensor 40 is compared with the level T2. When in the later case the detected value from the sensor becomes higher than T2, the motor m1 is operated to supply toner in order to regain the specified concentration of the toner. Consequently, the toner concentration (T/C ratio) of the developing unit employed is maintained at the desired value.

When a starter is introduced in the developing unit for operating the copying machine for the first time or when a new developer is used in place of the old developer, the key 29 for setting the ATDC sensor adjusting mode on the operation panel 28 in the copying machine is pressed to set the adjustment mode. In the present embodiment, a developer whose T/C ratio (8%) has been known is used for adjusting the output of the sensors.

Figure 15:
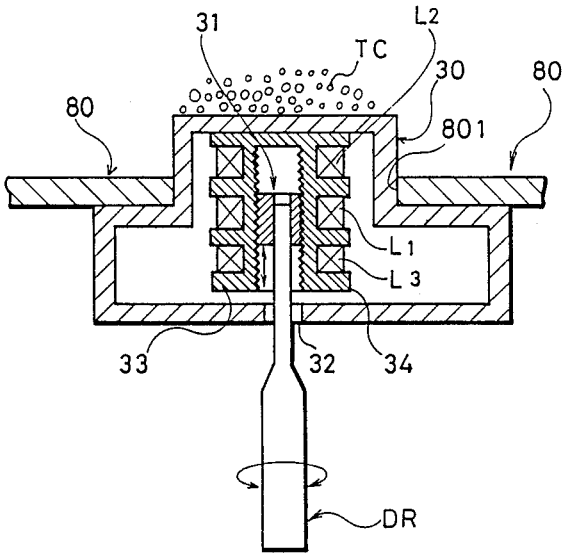
FIG.15 PRIOR ART
FIG. 15 is a cross sectional view of an example of a toner concentration sensor attached to an ordinary developing unit.
Figure 16:
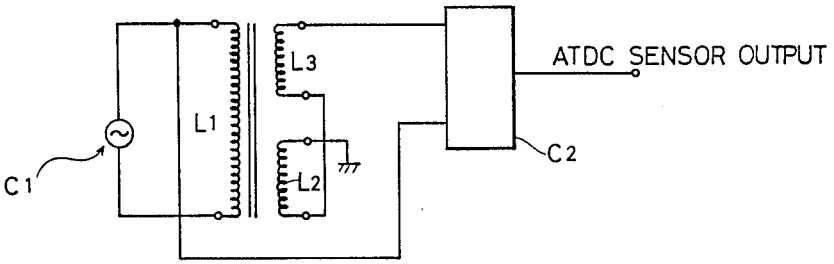
FIG.16 PRIOR ART
FIG. 16 is a circuit diagram of the sensor shown in FIG. 15.
Figure 17:
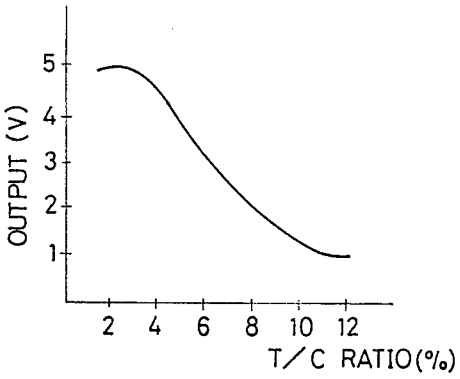
FIG.17 PRIOR ART
FIG. 17 is a graph showing an example of the output value of a common toner concentration sensor.
Figure 18:
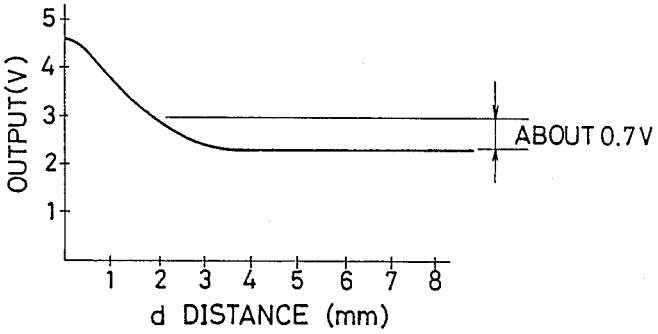
FIG.18 PRIOR ART
FIG. 18 is a graph showing a state in which a detected value of a common toner concentration sensor for controlling toner concentration of one developing unit, influenced by another developing unit.
Figure 19:
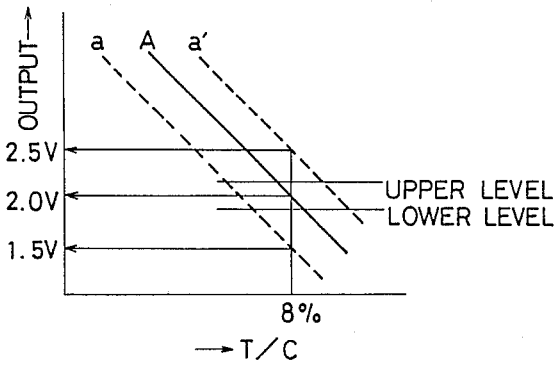
FIG.19 PRIOR ART
FIG. 19 is a graph showing a state in which an output value of a common toner concentration sensor which is to be adjusted, influenced by another developing unit.

The said adjustment mode is one of the function modes, in which the developing unit is operated without image formation. After a prescribed time period from the start of operation of developing unit started by turning on the key 29, the adjustment can be carried out for a prescribed time period by turning on the print switch K1. The said prescribed time period after the turning on of the key 29 is for stabilizing the flow of the developer, which may be arbitrarily set. It is 5 to 10 minutes in the present embodiment. The prescribed time period for adjustment is set to be about 3 minutes in general, during which time period the adjustment is carried out while checking states of the monitoring LED 30 on the operation panel 28. If the adjustment cannot be completed in this time period, the adjustment is continued by again pressing the print switch K1. The adjustment is carried out by inserting a driver DR through an opening 32 provided on the bottom of the sensor, and by changing the position of the ferrite core 31 by rotating the same until the LED 30 is turned ON, as shown in FIG. 15. The core 31 is screwed around a female screw hole 34 in the bobbin 33.

When the output value from the sensor reaches an intermediate level between predetermined upper and lower levels, the monitoring LED 30 is turned ON, and thus the adjustment is completed. Each of the upper and lower levels has two values, which values are stored in the microcomputer. Namely, one set of the upper and lower levels is used when a developing unit is provided below and close to the sensor, and another set of the upper and lower levels are used when there is no developing unit provided in the range in which the attachment of another developing unit influences the output of the sensor.

Figure 3B:
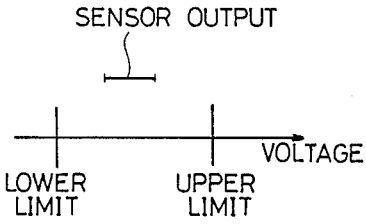
FIG. 3B illustrates relation between the output of a toner concentration sensor and the on/off state of a sensor output adjusting monitor LED in accordance with one embodiment of the present invention.

There are ripples on the sensor output level caused by fluctuation derived from waves of the developer. Therefore, the LED 30 is turned on when all the ripples are accommodated in the range from the lower to the upper levels, as shown in FIG. 3B. Although one monitoring LED is employed in the present embodiment, two monitoring LEDs may be provided corresponding to the upper and lower levels, which may be turned on corresponding to the set level.

The sensor output adjustment mode it cancelled when the key 29 is turned on again.

The operation of the microcomputer 51 will be hereinafter described with reference to FIGS. 5 to 14, mainly focused on the control of the toner concentration of the developer and on the control of ATDC sensor adjustment.

Figure 5:
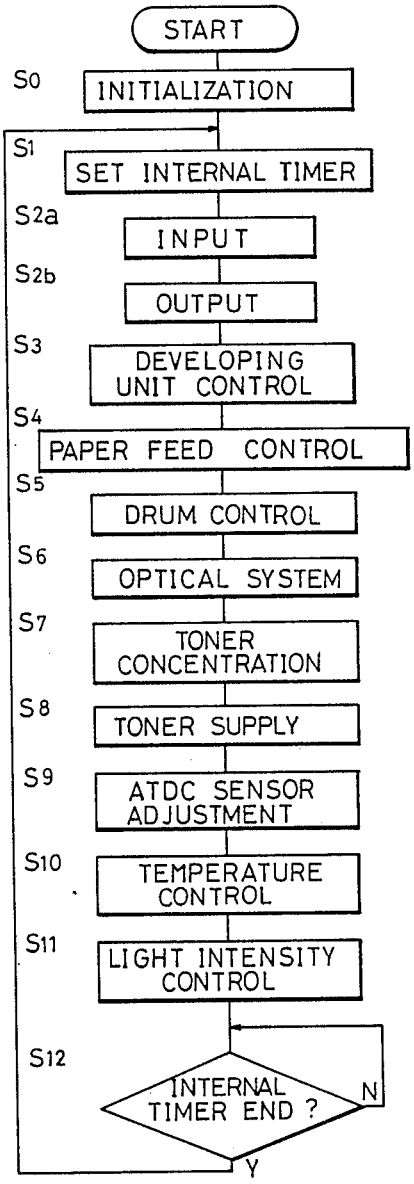
FIG. 5 is a flowchart of a main routine showing an operation of a microcomputer controlling the operation of the copying machine in accordance with one embodiment of the present invention.
Figure 6:
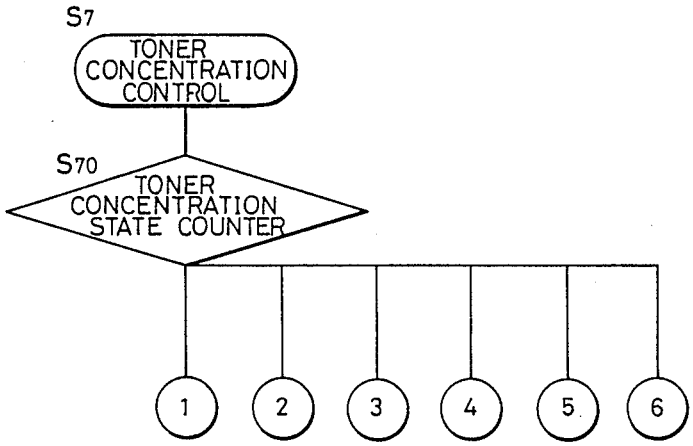
FIG. 6 is a flowchart showing details of a subroutine for controlling toner concentration of FIG. 5.
Figure 7:
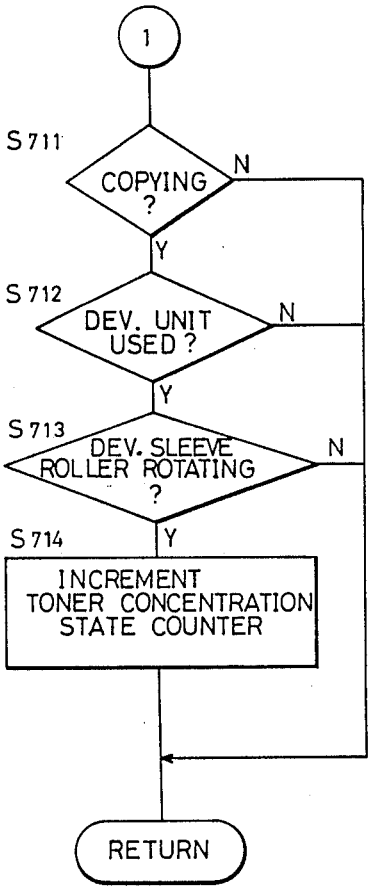
FIG. 7 is a flowchart showing an operation when a counter value shown in FIG. 6 is 1.
Figure 8:
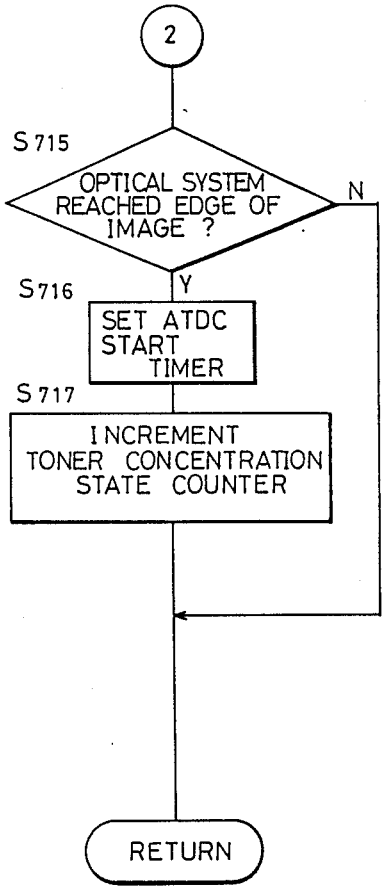
FIG. 8 is a flowchart showing the operation when the counter value of FIG. 6 is 2.
Figure 9:
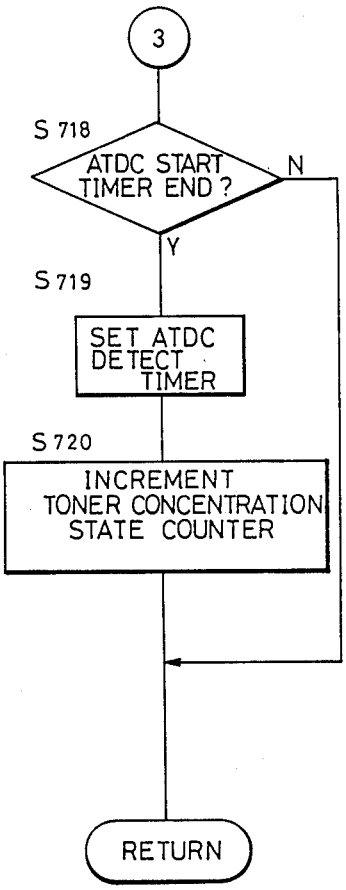
FIG. 9 is a flowchart showing the operation when the counter value of FIG. 6 is 3.
Figure 10:
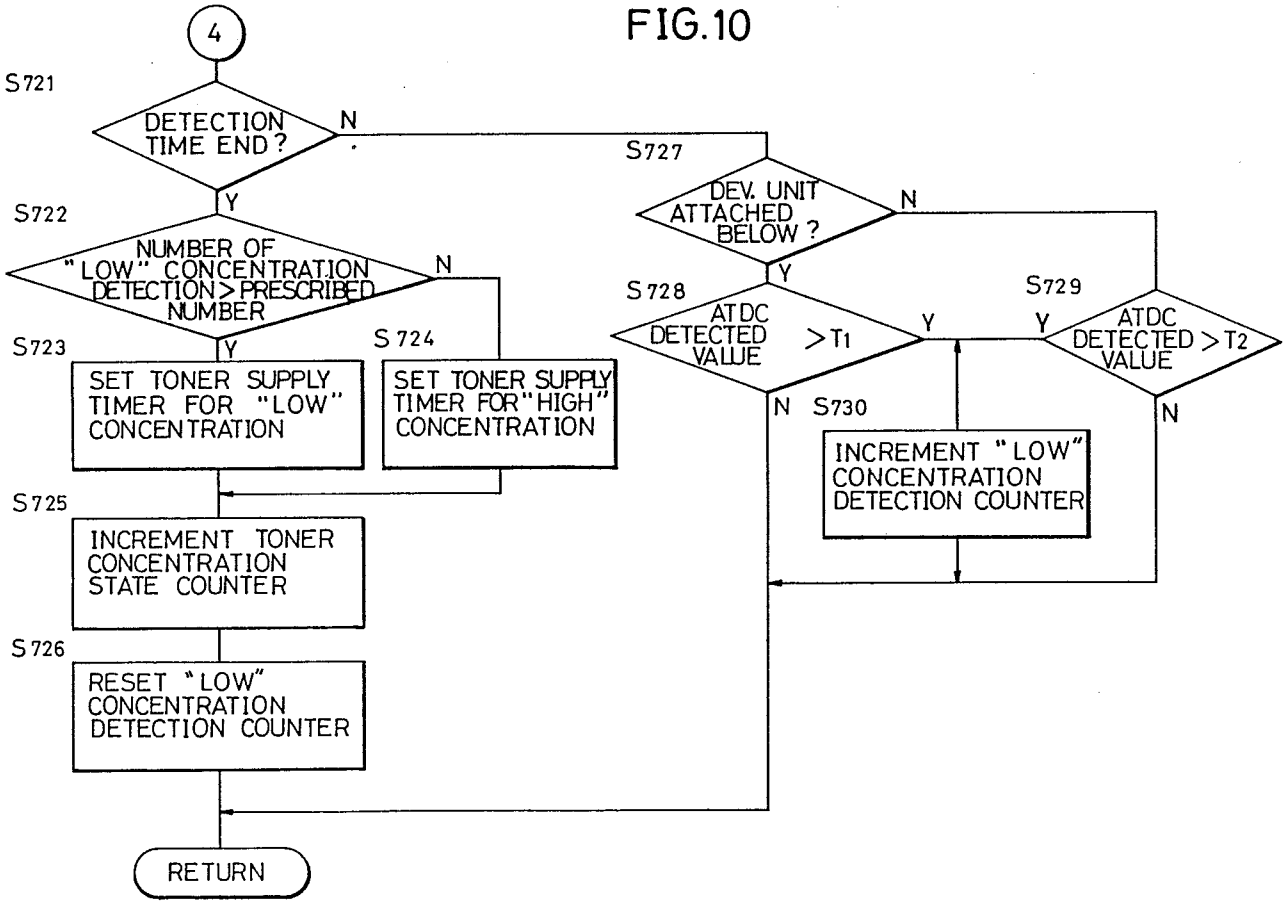
FIG. 10 is a flowchart showing the operation when the counter value of FIG. 6 is 4.
Figure 11:
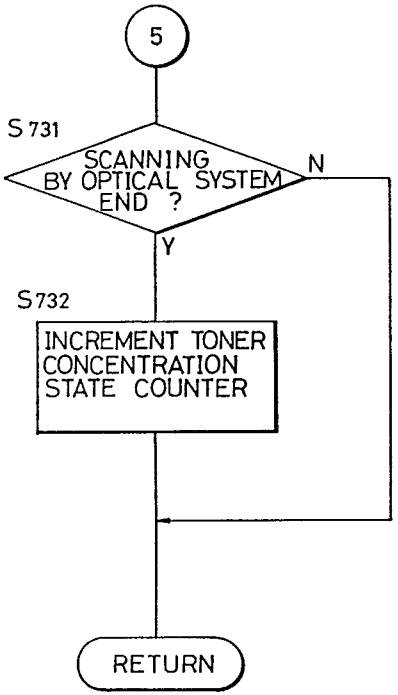
FIG. 11 is a flowchart showing the operation when the counter value of FIG. 6 is 5.
Figure 12:
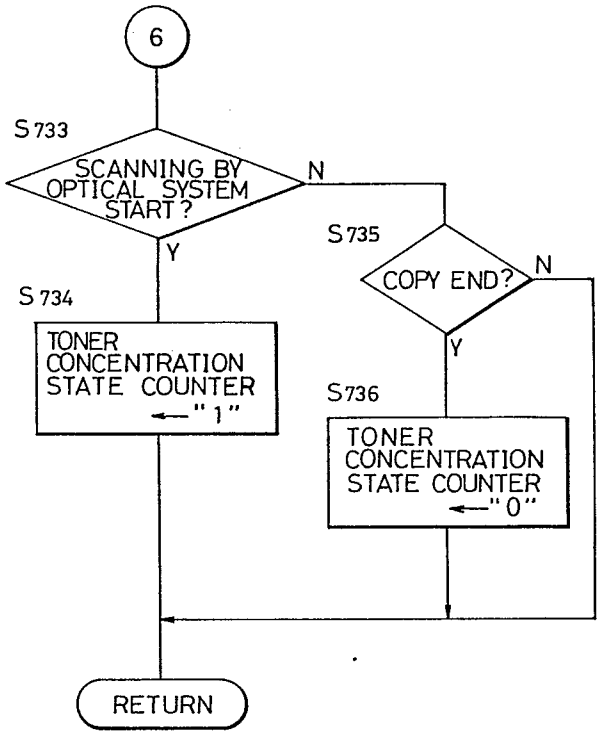
FIG. 12 is a flowchart showing the operation when the counter value of FIG. 6 is 6.

FIG. 5 is a schematic flowchart of the main routine illustrating the operation of the microcomputer 51. In the main routine, initialization is carried out in the step S0 in which a toner concentration state counter, various flags and the like, which will be described later, are initialized.

Thereafter, an internal timer contained in the microcomputer 51 whose value is set in the step of initialization is started in the step S1.

Respective subroutines S2*a* and S2*b* to S11 are successively called, and when all the processes of the subroutines are completed, one routine is terminated in the step S12 at the end of operation of the internal timer which was set initially. Thereafter the flow returns to the step S1. The length of this one routine is used for counting the various timers used in respective subroutines. The above mentioned subroutine S2*a* is for reading data inputted to the input ports of the microcomputer. The subroutine S2*b* is for outputting data for turning on/off respective loads from the output ports of the microcomputer. The subroutine S3 is for controlling the operations of the respective developing units 8, 10 and 12. The subroutines S4, S5 and S6 are for controlling the paper feeding operation, the operation of the photoreceptor 1 and the loads therearound, and the operation mainly of the optical system, respectively.

The subroutine S7 is for controlling the toner concentration; the subroutine S8 is for controlling the toner supply; the subroutine S9 is for controlling the ATDC sensor adjustment; the subroutine S10 is for controlling temperature of the fixing roller 22; and the subroutine S11 is for controlling the intensity of light from the exposure lamp in the scanner 26.

The control of the toner concentration will be described in the following with reference to FIGS. 6 to 12. The toner concentration controlling subroutine is carried out for one of the developing units 8, 10 and 12 which is selected at that time. In this subroutine, the toner concentration state counter is checked in the step S70. The counter is initialized in the step S0 of the main routine in a RAM of the microcomputer 51. The flow jumps to one of the branches 1 to 6 in accordance with the value of the counter.

First, proceeding to the step S711, whether the copying operation is being carried out or not is determined. When it is determined that the copying operation is being carried out and the print switch K1 on the operation panel P has been on, whether a developing unit is used or not is checked in S712. If the developing unit is used, then whether a sleeve roller in the developing unit is rotated or not is checked in the step S713. The reason why the rotation of the sleeve roller is checked is that the ATDC sensors 40, 41 and 42 provided in the developing units are structured to provide stable outputs only when the sleeve rollers are rotated.

If it is determined that the developing sleeve roller is being rotated in the step S713, the flow proceeds to S714 in which the toner concentration state counter is incremented, the flow returns to the main routine, and in the next routine the flow proceeds to the step S715. If the result of determination in each of the steps S711 to S713 is "NO", the flow directly returns to the main routine, and the flow again proceeds to the step S711 in the next routine.

In the step S715, whether the scanner 26 including the exposure lamp reached the edge of the original of the platen glass or not is checked. The reason for this is to control the toner concentration at every copying operation. If the scanner has not yet reached the edge, then the flow returns to the main routine. If it is determined in the step S715 that the scanner has reached the edge, then an ATDC starting timer is set in the step S716, the toner concentration state counter is incremented in the step S717, the flow returns to the main routine and proceeds to the step S718 in the next routine. The ATDC starting timer is set in the step S716 in order to wait for a rise time until the sensor output is stabilized. The timer is set in the RAM in the microcomputer 51.

In the step S718, whether the operation of the ATDC starting timer set in the step S716 is terminated or not is checked. If not, the flow returns to the main routine. If the operation of the timer is terminated, then the flow proceeds to the step S719 for starting detection, in which an ATDC detecting timer is set. Thereafter, in the step S720, the toner state counter is incremented, the flow returns to the main routine and proceeds to the step S721 in the next routine.

In the step S719, the ATDC detecting timer is set in order to set the number of times of comparison of the detected value from the sensor with the reference level value. More specifically, the detection of the toner concentration is carried out every time the subroutine for controlling the toner concentration is carried out, as will be described later, and the length of the main routine is constant, so that the total number of detection can be calculated by dividing the time set by the timer by the length of one routine. If the operation of the ATDC starting timer has not yet been completed in the step S718, then the flow directly returns to the main routine, and the flow proceeds to the step S718 again in the next routine.

In the step S711, whether the operation of the detection timer is completed or not is checked, and if not, the concentration of the toner is determined in the steps S727 to 730. In other words, the determination of the concentration is repeated in the steps S727 to 730 until the operation of the detection timer which was set in the step S719 is terminated.

In the step S727, whether or not there is another developing unit attached below the developing unit the toner concentration of which is to be controlled. If it is, whether the detected value from the sensor is larger than the reference level value T1 or not is determined in the step S718. If the detected value is larger, it means that the toner concentration is low, so that a counter ("low" concentration detecting counter) for detecting the low concentration is incremented in the step S730 and the control returns to the main routine. If there is no developing unit below (NO in the step S727), the whether the detected value from the sensor is larger than the reference level value T2 or not is determined in the step S729. If the detected value is larger, it means that the toner concentration is low, so that the counter is incremented in the step S730 to supply the toner, and the flow returns to the main routine. If the detected value from the ATDC sensor is no more than the level value in the step S728 or S729, it means that the toner concentration is not lowered, so that the flow directly returns to the main routine. The counter used in the step S730 is also stored in the RAM in the microcomputer 51. The reference level value to be compared with the detected value from the ATDC sensor is changed dependent on the presence/absence of the developing unit below the sensor, thereby eliminating errors in detection.

When all detections are completed, whether the counted number of the "low" concentration detecting counter used in the step S730 exceeds a prescribed number or not is checked in the step S722. The determination is carried out based on the proportion to the total number of detection. If the number of detection of the "low" concentration of the toner is larger than the prescribed number, then a toner supply timer for low concentration of the toner is set in the step S723. If the number of detection of the "low" concentration is no more than the prescribed number, then a toner supply timer for a shorter time period is set in the step S724.

Thereafter, the toner concentration state counter is incremented in the step S715, the toner "low" concentration detecting counter is reset in the step S726, the flow returns to the main routine and proceeds to the step S731 in the next routine.

In the next step S731, whether the scanning of the optical system 25 has been terminated or not is checked. If the scanning is completed, then the toner concentration state counter is incremented in the step S732, the flow returns to the main routine and proceeds to the step S733 in the next routine. If the scanning of the optical system has not yet completed in the step S731, the flow directly returns to the main routine and again proceeds to the step S731 in the next routine.

In the step S733, whether the next scanning by the optical system for continuously taking a plurality of copies is started or not is checked. If it is started, the toner concentration state counter is set at "1" in the step S734, the flow returns to the main routine and the same operation is repeated.

If the next scanning by the optical system has not yet started in S733, then whether the copying operation is terminated or not is determined in the step S735. If it is terminated, then the toner concentration state counter is set to "0" in the step S736, thereby terminating the control of the toner concentration. Otherwise, the flow returns to the main routine.

Figure 13:
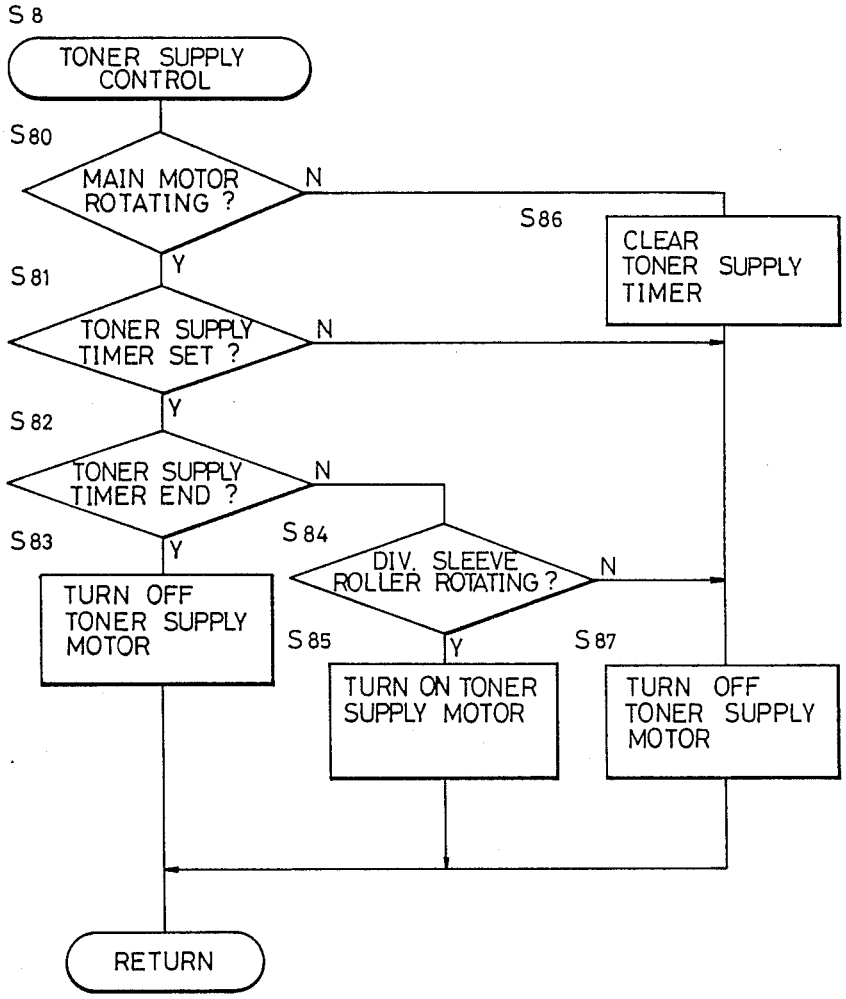
FIG. 13 is a flowchart showing the specific content of the subroutine for controlling toner supply of FIG. 5.

The subroutine for controlling the toner supply will be described in the following with reference to FIG. 13. This subroutine is carried out for the developing unit employed.

In the step S80, whether or not the main motor 27 in the copying machine is rotated is checked. The reason for this is that the sleeve roller in the developing unit is driven by the main motor and the developer is not transferred when the sleeve roller is stopped.

In the step S81, whether or not the toner supply timer is set is checked. The value of the timer is set in the step S723 or S724 in the subroutine for controlling the toner concentration.

If this timer is not set, then the toner supply motor is stopped in the step S87. If the toner supply timer has been set, then whether the operation of the timer is terminated or not is checked in the step S82. If the operation of the timer has been terminated, then the toner supply motor is stopped in the step S83. Otherwise, whether the developing sleeve roller is being rotated or not is checked in the step S84. If the sleeve roller is rotating in the step S84, then the toner supply motor is turned ON in the step S85. If not, the toner supply motor is stopped in the step S87. By doing so, the developer is supplied from the hopper to the developer tank by the rotation of the toner supply motor to maintain the constant concentration of the toner when the toner supply timer is set, when the main motor is being operated, and when the developing sleeve roller is being rotated.

Figure 14:
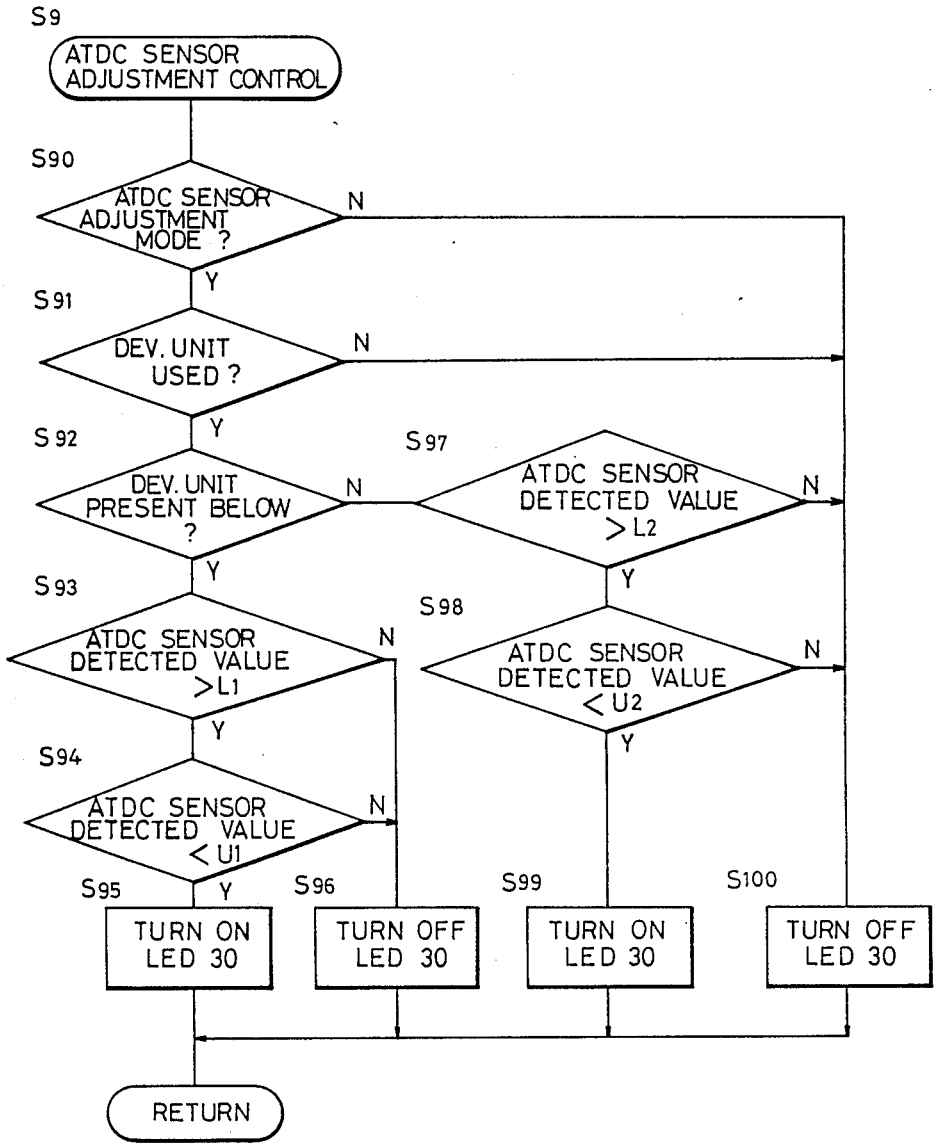
FIG. 14 is a flowchart showing specific contents of the subroutine for controlling adjustment of an ATDC sensor shown in FIG. 5.

The routine for controlling the ATDC sensor adjustment will be described in the following with reference to FIG. 14.

This subroutine is carried out on the developing unit which is selected to be used.

In the sensor adjustment mode, operations different from the copying operation are carried out in the respective subroutines in the main routine shown in FIG. 5. For example, in the step S3, the developing sleeve roller of the selected developing unit is rotated, and in the step S5, the main motor 27 is rotated, without the pressing of the print button in both steps, and other portions such as paper feeding rollers are not operated.

In the step S90, whether the ATDC sensor adjustment mode has been set or not is determined, and if it has been set, then the developing unit, on which the sensor to be adjusted is attached, is in operation or not is checked in the step S91. In other words, whether the developing sleeve roller in the said developing unit is rotated or not is checked. If the sleeve roller is rotated, then whether there is another developing unit provided below the said developing unit or not is checked in the step S92. If there is, then whether or not the detected value from the ATDC sensor is between the prescribed lower level L1 and the upper level U1 used when a developing unit is provided below the objective developing unit is determined in the steps S93 and S94.

If it is determined that there is no developing unit below in the step S92, then whether or not the value detected by the ATDC sensor is between the predetermined lower level L2 and the upper level U2 used when there is no developing unit below is checked in the steps S97 and S98.

If the value detected by the ATDC sensor is between the upper and lower levels in the steps S93 and S94 or in the steps S97 and S98, then the LED 30 for monitoring the ATDC sensor adjustment is turned on in the step S95 or in S99. Otherwise, the LED 30 is turned off in the step S96 or S100, and the flow returns to the main routine. If the result of determination is "NO" in the steps S90 and S91, then the monitoring LED is turned off in the step S100 and the flow returns to the main routine.

According to the present invention, the toner concentration of a developing unit which is actually used can be maintained at a desired concentration regardless of the presence/absence of a developing unit influencing the detected value of the toner concentration sensor provided on the developing unit whose concentration is to be controlled, even if a plurality of developing units are attached.

In addition, according to the present invention, adjustment of the toner concentration sensor can be carried out to enable control of the desired toner concentration, regardless of the presence/absence of other developing units having influences to the output value of the sensor which is is to be adjusted.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An electrophotographic image forming apparatus employing a two-component developer including toner and carrier, comprising:

a developing unit containing the two-component developer;

a toner concentration sensor provided on said developing unit for detecting concentration of the toner included in the developer;

comparing means for comparing a value detected by said toner concentration sensor with a prescribed concentration reference value;

supplying means for supplying toner to said developing unit;

controlling means for controlling supply of toner by said supplying means based on a result of comparison by said comparing means; and detecting means for detecting whether or not a detachable member, whose presence/absence influences detection of said toner concentration sensor, is attached near said developing unit; wherein said controlling means changes an amount of toner supplied by said supplying means based on the value detected by said toner concentration sensor in response to a detection output from said detecting means.

2. An electrophotographic image forming apparatus according to claim 1, wherein said toner concentration sensor detects permeability of the developer.

3. An electrophotographic image forming apparatus according to claim 2, wherein said image forming apparatus comprises a plurality of developing units, and said detecting means detects whether or not a prescribed one of the developing units is attached.

4. An electrophotographic image forming apparatus according to claim 3, wherein said detecting means detects whether or not a developing unit is attached next to a developing unit to which said supplying means supplies the toner.

5. An electrophotographic image forming apparatus according to claim 4, wherein said toner concentration sensor is provided at a lower portion of each of said developing units provided stacked on each other, and said detecting means detects whether or not a developing unit is attached below a developing unit to which said supplying means supplies the toner.

6. An electrophotographic image forming apparatus according to claim 1, wherein said member comprises a member formed of a magnetic substance.

7. An electrophotographic image forming apparatus employing a two-component developer including toner and carrier, comprising:

a developing unit including the two-component developer;

a toner concentration sensor provided on said developing unit for detecting concentration of the toner included in the developer;

comparing means for comparing a value detected by said toner concentration sensor with a prescribed concentration reference value;

supplying means for supplying toner to said developing unit;

controlling means for controlling supply of toner by said supplying means based on a result of comparison by said comparing means;

detecting means for detecting whether or not a detachable member, whose presence/absence influences the detection carried out by said toner concentration sensor, is attached near said developing unit; and changing means for changing said prescribed concentration reference value in response to the detected output from said detecting means.

8. An electrophotographic image forming apparatus according to claim 7, wherein said toner concentration sensor detects permeability of the developer and outputs a corresponding electric amount.

9. An electrophotographic image forming apparatus according to claim 8, wherein said image forming apparatus comprises a plurality of developing units and said detecting means detects whether or not a prescribed one of the developing units is attached.

10. An electrophotographic image forming apparatus according to claim 9, wherein said toner concentration sensor is provided on a bottom portion of each of the developing units, and said changing means changes said prescribed concentration reference value dependent on whether or not a developing unit is attached directly below a developing unit to which said supplying means supplies the toner.

11. An electrophotographic image forming apparatus according to claim 10, wherein said developing unit comprises a magnetic material, and said prescribed concentration reference when a developing unit is attached below is higher than that when there is no developing unit attached below.

12. An electrophotographic copying apparatus employing a two-component developer including toner and carrier, comprising:

a plurality of developing units each being detachable and containing the two-component developer;

a sensor for detecting permeability of the developer contained in each of said developing units;

supplying means for supplying toner to each of said developing units;

selecting means for selecting one of said developing units;

controlling means for controlling said toner supplying means such that the toner supply is carried out to the developing unit selected by said selecting means based on the detected output from said sensor; and detecting means for detecting whether or not a prescribed one of said developing unit is attached; wherein said controlling means changes an amount of toner supplied by said supplying means to the selected developing unit based on the detected output from said detecting means, dependent on whether or not a developing unit near the developing unit selected by said selecting means is attached.

13. An image forming apparatus, comprising:

a plurality of developing units each being detachable and containing a two-component developer;

a toner concentration sensor provided in each of said developing units for detecting concentration of the toner included in the developer;

output comparing means for comparing a detected output by said toner concentration sensor with a prescribed output reference value to output a result of comparison;

adjusting means for adjusting an output value from said toner concentration sensor;

detecting means for detecting whether or not a prescribed one of the developing units is attached; and changing means for changing said output reference value based on the detected output from said detecting means.

14. An image forming apparatus according to claim 13, wherein said toner concentration sensor detects permeability of the developer.

15. An image forming apparatus according to claim 14, further comprising:

developing units selecting means for selecting one of said developing units; wherein said output comparing means compares a detected output from the toner concentration sensor provided in the developing unit selected by said developing unit selecting means with said output reference value.

16. An image forming apparatus according to claim 14, further comprising:

displaying means for displaying the result of comparison by said output comparing means.

17. An image forming apparatus according to claim 14, further comprising:

concentration comparing means for comparing the detected output from said toner concentration sensor with a prescribed concentration reference value;

supplying means for supplying toner to each of said developing units;

controlling means for controlling supplying operation of said supplying means based on the result of comparison by said concentration comparing means; and changing means for changing said prescribed concentration reference value based on the detected output from said detecting means.

18. A toner concentration detecting apparatus in an electrophotographic image forming apparatus having a plurality of developing units each being detachable and containing a two-component developer including toner and carrier, comprising:

a sensor provided on one of said developing units for detecting permeability of the developer;

detecting means for detecting whether or not another one of said developing unit is attached;

comparing means for comparing a detected value from said sensor with a prescribed reference value to output the result of comparison; and changing means for changing said prescribed reference value based on the detected output from said detected means.

19. A toner concentration adjusting apparatus in an electrophotographic image forming apparatus, comprising:

a plurality of developing units, each being detachable and containing a two-component developer including toner and carrier;

a plurality of concentration sensors each provided on each of said developing units for detecting toner concentration of the developer in the developing unit to which it is attached, the detection output therefrom being influenced by presence/absence of another one of said developing units near the developing unit to which the sensor is attached;

developing unit designating means for designating one of the developing units whose toner concentration is to be adjusted;

determining means for determining state of attachment of the developing units near the developing unit designated by said developing unit designating means; and output adjusting means for adjusting the detected output of the concentration sensor attached to said designated developing unit in response to a determining output from said determining means.

20. A toner concentration adjusting apparatus according to claim 18, wherein each of said concentration sensor is attached at a prescribed portion of each of said developing units, and the detection output therefrom fluctuates dependent on presence/absence of attachment of the developing unit adjacent to and facing said prescribed position.

21. A method for adjusting toner concentration in a plurality of developing units each of which can be attached to and removed from an image forming portion and has a two-component developer including toner and carrier, in an electrophotographic image forming apparatus, comprising the steps of:

selecting one of said developing units whose toner concentration is to be adjusted;

detecting the toner concentration of the developer of said selected developing unit;

detecting whether or not another one of the developing units is attached near said selected developing unit; and comparing the detected toner concentration with a reference value which changes dependent on presence/absence of attachment of another one of the developing units and controlling supply of toner to the selected developing unit based on the result of comparison.

22. A method for adjusting toner concentration according to claim 21, wherein an amount of toner supply to the selected developing unit is changed in said step of controlling the toner supply.

* * * * *

UNITED STATES PATENT AND TRADEMARK OFFICE

CERTIFICATE OF CORRECTION

PATENT NO. : 4,955,317

DATED : September 11, 1990

INVENTOR(S) : Naoyoshi KINOSHITA, et al.

It is certified that error appears in the above-identified patent and that said Letters Patent is hereby corrected as shown below:

Title page, insert:

[30] Foreign Application Priority Data

May 26, 1988 [JP] Japan ..... 63-129183
May 26, 1988 [JP] Japan ..... 63-129184

Signed and Sealed this

Tenth Day of December, 1991

*Attest:*

HARRY F. MANBECK, JR.

*Attesting Officer*

*Commissioner of Patents and Trademarks*